US008234762B2

(12) United States Patent
Larbrisseau

(10) Patent No.: US 8,234,762 B2
(45) Date of Patent: Aug. 7, 2012

(54) DISPLAY STRUCTURE

(76) Inventor: Michel Larbrisseau, Ville Lasalle (CA)

( * ) Notice: Subject to any disclaimer, the term of this patent is extended or adjusted under 35 U.S.C. 154(b) by 231 days.

(21) Appl. No.: 11/918,647

(22) PCT Filed: Apr. 19, 2006

(86) PCT No.: PCT/CA2006/000632
§ 371 (c)(1),
(2), (4) Date: Oct. 17, 2007

(87) PCT Pub. No.: WO2006/111023
PCT Pub. Date: Oct. 26, 2006

(65) Prior Publication Data

US 2009/0064546 A1 Mar. 12, 2009

(30) Foreign Application Priority Data

Apr. 19, 2005 (GB) ..... 0507855.5

(51) Int. Cl.
*A61G 17/00* (2006.01)

(52) U.S. Cl. ..... 27/1; 211/85.27; 220/796

(58) Field of Classification Search ..... 27/1, 35; D99/5; 52/103–104, 133, 134, 136; 40/124.5, 40/406, 409–410, 1; 220/796, 802; 211/85.27
See application file for complete search history.

(56) References Cited

U.S. PATENT DOCUMENTS 6,023,822 A * 2/2000 Luebke ..... 27/1
6,052,954 A * 4/2000 Dudek et al. ..... 52/128
6,161,268 A * 12/2000 Joseph ..... 27/35
6,463,703 B1 * 10/2002 Mattis ..... 52/103
6,523,287 B1 * 2/2003 Lee ..... 40/410
6,584,658 B2 * 7/2003 Robinson ..... 27/1
6,854,165 B1 * 2/2005 Parker ..... 27/1
6,904,721 B1 * 6/2005 Forbes ..... 52/103
6,988,299 B1 * 1/2006 Barrette et al. ..... 27/1
7,406,754 B2 * 8/2008 Trail ..... 27/1
7,478,461 B2 * 1/2009 Glass ..... 27/1
7,627,935 B1 * 12/2009 Ostrum ..... 27/1

* cited by examiner

*Primary Examiner* — William L. Miller

(57) ABSTRACT

A display structure for displaying an object includes a display container defining a container inner volume for containing the object. The display container has a substantially elongated configuration and allows at least partial visual access into at least a portion of the container inner volume. The display container defines a container aperture leading thereinto located substantially adjacent a container first end. The display structure also includes a container cap mountable to the display container in a closing configuration for substantially closing the container aperture. The display structure further includes a base member for at least partially supporting the display container. The base member has a container receiving aperture extending at least partially therethrough. The container receiving aperture receives a portion of the display container so as to at least partially support the display container in a supported configuration. With the container cap in the closing configuration and the display container in the supported configuration, the container cap is used both for closing the container aperture and for participating in the supporting of the display container.

13 Claims, 4 Drawing Sheets

DISPLAY STRUCTURE

FIELD OF THE INVENTION

The present invention relates to the general field of display structures and is particularly concerned with a structure for displaying objects such as relics or the like.

BACKGROUND OF THE INVENTION

There exists a plurality of situations wherein it is desirable to contain various types of products or objects and display these products or objects in an aesthetic manner. For example, individuals may wish to retain and display the ashes resulting from the cremation of a loved one. Individuals may also wish to display tufts of fur from a loved animal or of hair from a loved one. In other instances, individuals may further wish to display fluids having a sentimental or aesthetical value such as selected liquids or gaseous products.

Although the prior art is replete with various types of display structures, such prior art structures suffer from some drawbacks. Indeed, prior art structures are often unsuitable for displaying relatively elongated and malleable products such as tufts of fur, hair or the like. Such prior art structures are also often unsuitable for displaying fluids.

Furthermore, some prior art structures only allow the displayed article to be viewed from a limited number of viewing angles. Also, some prior art structures are simply not designed so as to be in themselves aesthetically pleasing and, hence, having a deleterious effect on the aesthetical characteristics of the object being displayed.

Some prior art structures are also relatively unstable and, hence, have a propensity to being knocked down, leading to potential damage to the display structure and/or to the object being displayed. Furthermore, some prior art structures suffer from being overly complex and expensive.

Accordingly, there exists a need for an improved display structure. It is a general object of the present invention to provide such an improved display structure.

SUMMARY OF THE INVENTION

In accordance with the present invention, there is provided a display structure for displaying an object, the display structure comprising a display container defining a container inner volume for containing the object, the display container having a substantially elongated configuration defining a container first end and a substantially longitudinally opposed container second end, the display container allowing at least partial visual access from the exterior of the display container into at least a portion of the container inner volume; the display container defining a container aperture leading thereinto, the container aperture being located substantially adjacent the container first end; a container cap, the container cap being mountable to the display container in a closing configuration for substantially closing the container aperture; a base member for at least partially supporting the display container, the base member having a container receiving aperture extending at least partially therethrough, the container receiving aperture defining a receiving aperture peripheral surface; the container receiving aperture being configured and sized for receiving a receivable portion of the display container so as to at least partially support the display container in a supported configuration; the container cap being provided with a contacting portion, the contacting portion being configured, sized and positioned such that with the container cap in the closing configuration and the display container in the supported configuration the contacting portion contacts at least a portion of the container aperture peripheral wall, the contact between the contacting portion and the at least a portion of the receiving aperture peripheral surface at least partially supporting the display container in the supported configuration; wherein with the container cap in the closing configuration and the display container in the supported configuration, the container cap is used both for closing the container aperture and for participating in the supporting of the display container.

Preferably, the contacting portion is configured, sized and positioned such that with the container cap in the closing configuration and the display container in the supported configuration the contacting portion frictionally contacts the receiving aperture peripheral surface so as to frictionally retain the receivable portion of the display container in the container receiving aperture; wherein with the container cap in the closing configuration and the display container in the supported configuration, the container cap is also used for frictionally retaining the receivable portion of the display container in the container receiving aperture.

Typically, the contacting portion is made out of resiliently deformable material for being resiliently deformed when the receivable portion of the display container is received in the container receiving aperture. In at least one embodiment of the invention, at least a portion of the container cap is coated with a substantially resiliently deformable material.

In at least one embodiment of the invention, a contacting portion protrudes substantially radially outwardly from the remainder of the container cap for frictionally contacting the receiving aperture peripheral surface so as to frictionally retain the receivable portion of the display container in the container receiving aperture.

Conveniently, the display container is a tube defining a tube peripheral wall having a tube wall outer surface; the container cap including a peripheral cap sleeve mountable over the tube wall outer surface and a cap plate extending from the cap sleeve for extending across the container receiving aperture; the cap sleeve includes a sleeve first section extending from the cap plate and a sleeve second section extending from the sleeve first section away from the cap plate; the sleeve second section tapering radially inwardly in a direction leading away from the sleeve first section.

Conveniently, the display container is a tube defining a tube peripheral wall having a tube wall outer surface; the display container cap including a cap sleeve mountable over the tube wall outer surface and a cap plate for extending across the container receiving aperture; the container being provided with a sleeve receiving section for receiving at least a portion of the cap sleeve, the sleeve receiving section being located substantially adjacent the container first end; the sleeve receiving recess being recessed radially inwardly relative to the remainder of the tube wall outer surface.

Typically, the base member defines a base first surface and a substantially opposed base second surface, the container receiving aperture extending through the base member from the base first surface to the base second surface; the display container is a tube defining a tube peripheral wall having a tube wall outer surface; the container cap including a cap sleeve mountable over the tube wall outer surface and a cap plate for extending across the container receiving aperture; the container receiving aperture includes an aperture first section extending from the base first surface for receiving the cap sleeve and an aperture second section extending from the base second section for receiving a portion of the display container; the cap sleeve is configured, sized and positioned such that with the container cap in the closing configuration and the display container in the supported configuration the cap sleeve frictionally contacts at least a portion of the receiving aperture peripheral surface of the aperture first section so as to frictionally retain the receivable portion of the display container in the container receiving aperture; wherein with the container cap in the closing configuration and the display container in the supported configuration, the container cap is used both for closing the container aperture and for frictionally retaining the receivable portion of the display container in the container receiving aperture.

Conveniently, the display container and the aperture second section are configured and sized such that when the display container is in the supported configuration the aperture second section substantially fittingly receives the display container so that the outer surface of the display container contacts the receiving aperture peripheral surface of the aperture second section; the contact between the display container and the receiving aperture peripheral surface of the aperture second section at least partially supporting the display container in the supported configuration.

Typically, the display structure further comprises a stabilizing section extending substantially outwardly from the base member, the stabilizing section being configured, sized and positioned for contacting a portion of the display container protruding from the base member when the display container is in the supported configuration.

Conveniently, the stabilizing section is configured, sized and positioned for contacting a portion of the display container located substantially adjacent to the container second end.

In at least one embodiment of the invention, the stabilizing section is releasably attached to the base member.

In at least one embodiment of the invention, the stabilizing section is provided with a stabilizing recess formed therein, the stabilizing section and the stabilizing recess being configured, sized and positioned such that a portion of the display container located adjacent the container second end is received within the stabilizing recess when the display container is in the supported configuration.

In at least one embodiment of the invention, the display container has a container auxiliary aperture leading thereinto, the container auxiliary aperture being located substantially adjacent the container second end; the stabilizing recess having a recess surface, the stabilizing recess being configured, sized and positioned such that a the recess surface closes the container auxiliary aperture when the portion of the display container located adjacent the container second end is received within the stabilizing recess with the display container in the supported configuration.

In at least one embodiment of the invention, the stabilizing recess is configured, sized and positioned for receiving the auxiliary cap when the display container is in the supported configuration. Typically, at least an auxiliary portion of the auxiliary cap is made out of resiliently deformable material for being resiliently deformed when the auxiliary cap is received in the auxiliary aperture.

In accordance with the present invention, there is also provided, in combination, a display object and display structure for displaying the display object, the display structure comprising: a display container defining a container inner volume containing the display object, the display container having a substantially elongated configuration defining a container first end and a substantially longitudinally opposed container second end, the display container allowing at least partial visual access from the exterior of the display container into at least a portion of the container inner volume; the display container defining a container aperture leading thereinto, the container aperture being located substantially adjacent the container first end; a container cap, the container cap being mountable to the display container in a closing configuration for substantially closing the container aperture; a base member for at least partially supporting the display container, the base member having a container receiving aperture extending at least partially therethrough, the container receiving aperture defining a receiving aperture peripheral surface; the container receiving aperture being configured and sized for receiving a receivable portion of the display container so as to at least partially support the display container in a supported configuration; the container cap being provided with a contacting portion, the contacting portion being configured, sized and positioned such that with the container cap in the closing configuration and the display container in the supported configuration the contacting portion contacts at least a portion of the container aperture peripheral wall, the contact between the contacting portion and at least a portion of the receiving aperture peripheral surface at least partially supporting the display container in the supported configuration; wherein with the container cap in the closing configuration and the display container in the supported configuration, the container cap is used both for closing the container aperture and for participating in the supporting of the display container.

Advantages of the present invention include that the proposed display structure is particularly well suited for displaying various types of objects including granular material, ashes, relatively elongated and malleable products such as tufts of fur, hair or the like and also fluids including liquid and gaseous products.

The proposed display structure is designed so as to allow visualisation of the object being displayed from various angles. Also, the proposed display structure is designed so as to be in itself aesthetically pleasing.

Yet, still furthermore, the proposed display structure is designed so as to be relatively stable and reduce the risks of having the object being displayed knocked down or otherwise damaged.

Yet, still furthermore, the proposed display structure is designed so as to be manufacturable using conventional forms of manufacturing and conventional materials so as to provide a display structure that will be economically feasible, long-lasting and relatively trouble-free in operation.

Yet, still furthermore, in at least one embodiment of the invention, the proposed display structure is designed so as to allow for modification of its appearance through a set of quick and ergonomical steps without requiring special tooling or manual dexterity. The aesthetical appearance of the display structure may, hence, be modified according to the type of object being displayed and/or in order to provide an element of novelty over time.

In accordance with the present invention, there is provided . . .

BRIEF DESCRIPTION OF THE DRAWINGS

An embodiment of the present invention will now be disclosed, by way of example, in reference to the following drawings in which.

DETAILED DESCRIPTION

Figure 1:
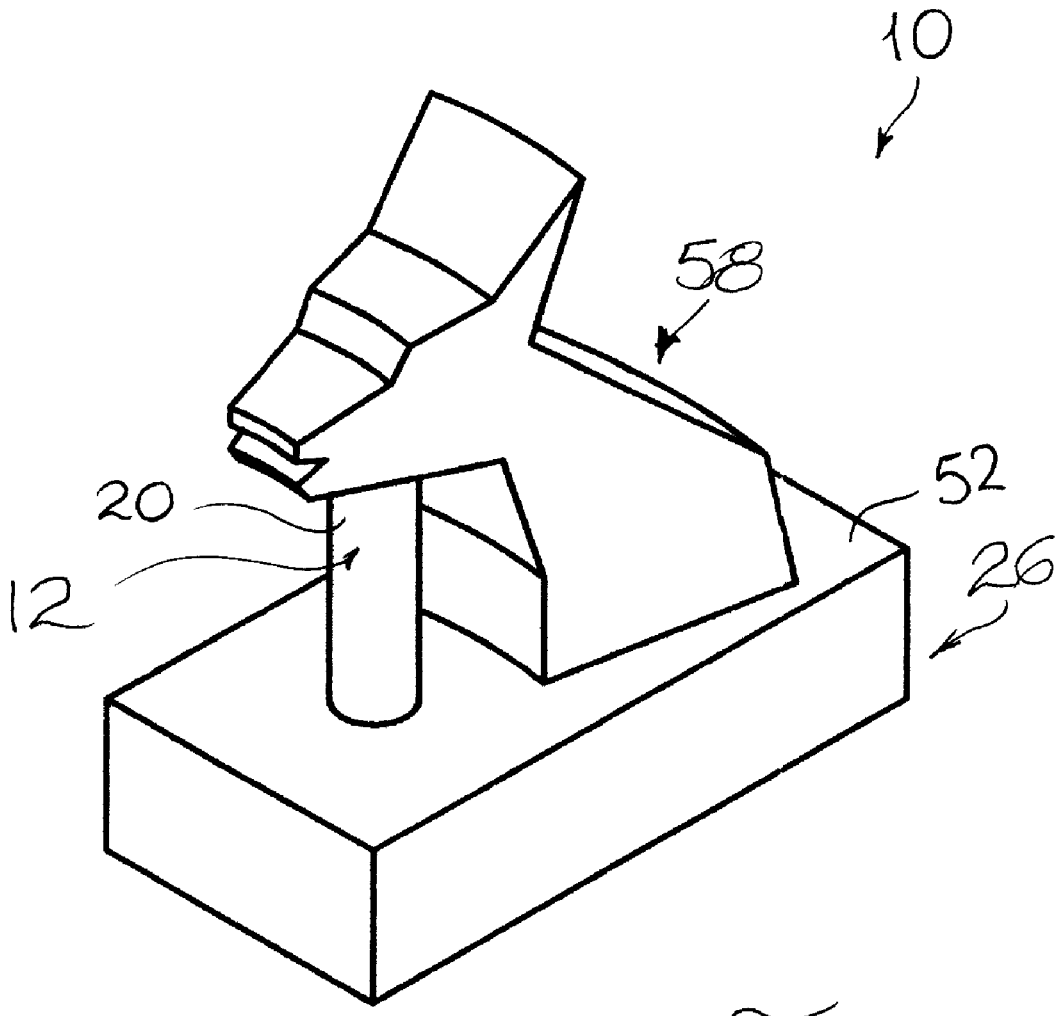
FIG. 1, in a top perspective view, illustrates a display structure in accordance with an embodiment of the present invention.
Figure 2:
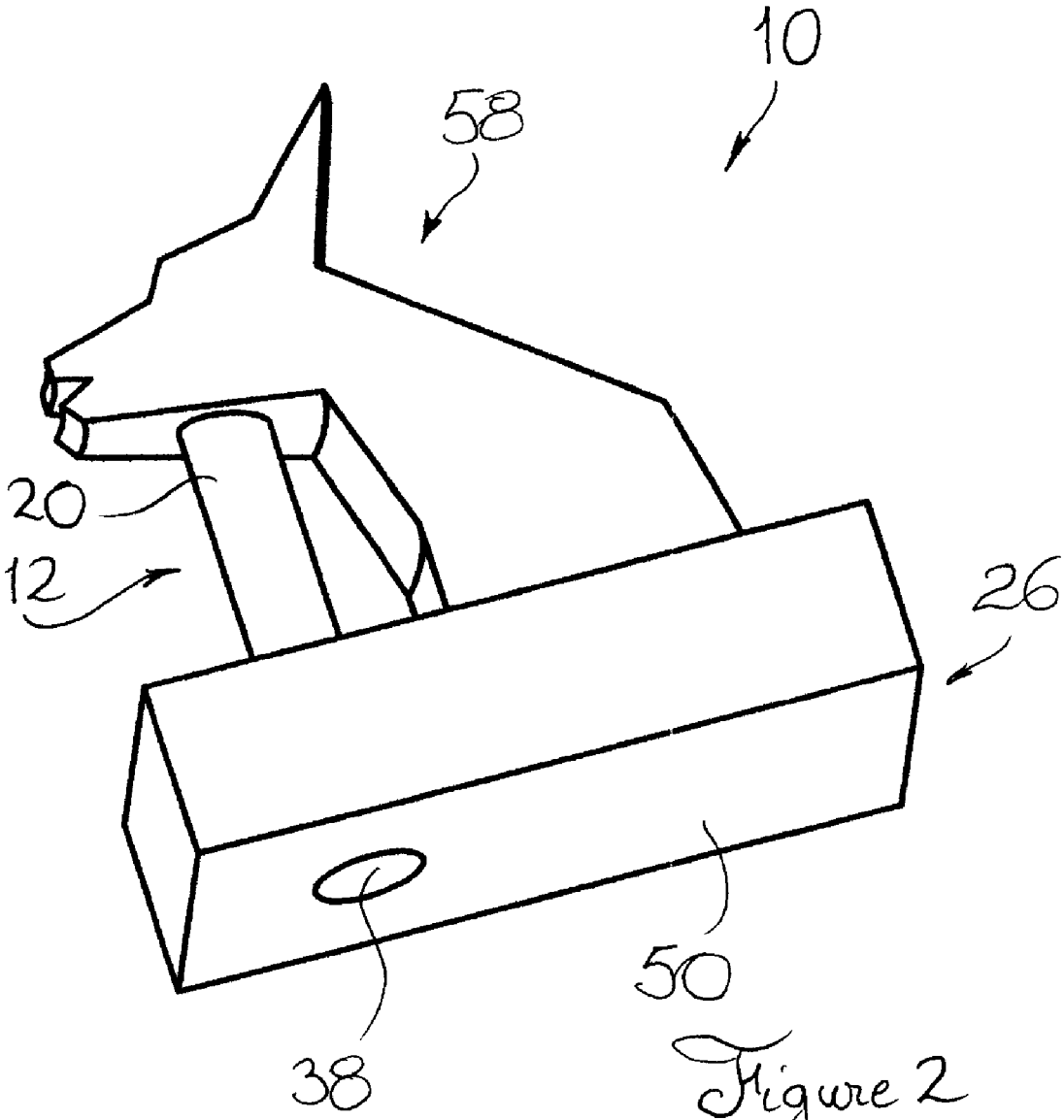
FIG. 2, in a bottom perspective view, illustrates the display structure shown in FIG. 1.

Referring to FIG. 1, there is shown a display structure in accordance with an embodiment of the present invention, generally indicated by the reference numeral 10. The display structure 10 is adapted to be used for displaying an object (not shown). The object may take any suitable form, including that of a granular object, a solid object, a liquid object, a gaseous object or any other suitable object.

Figure 3:
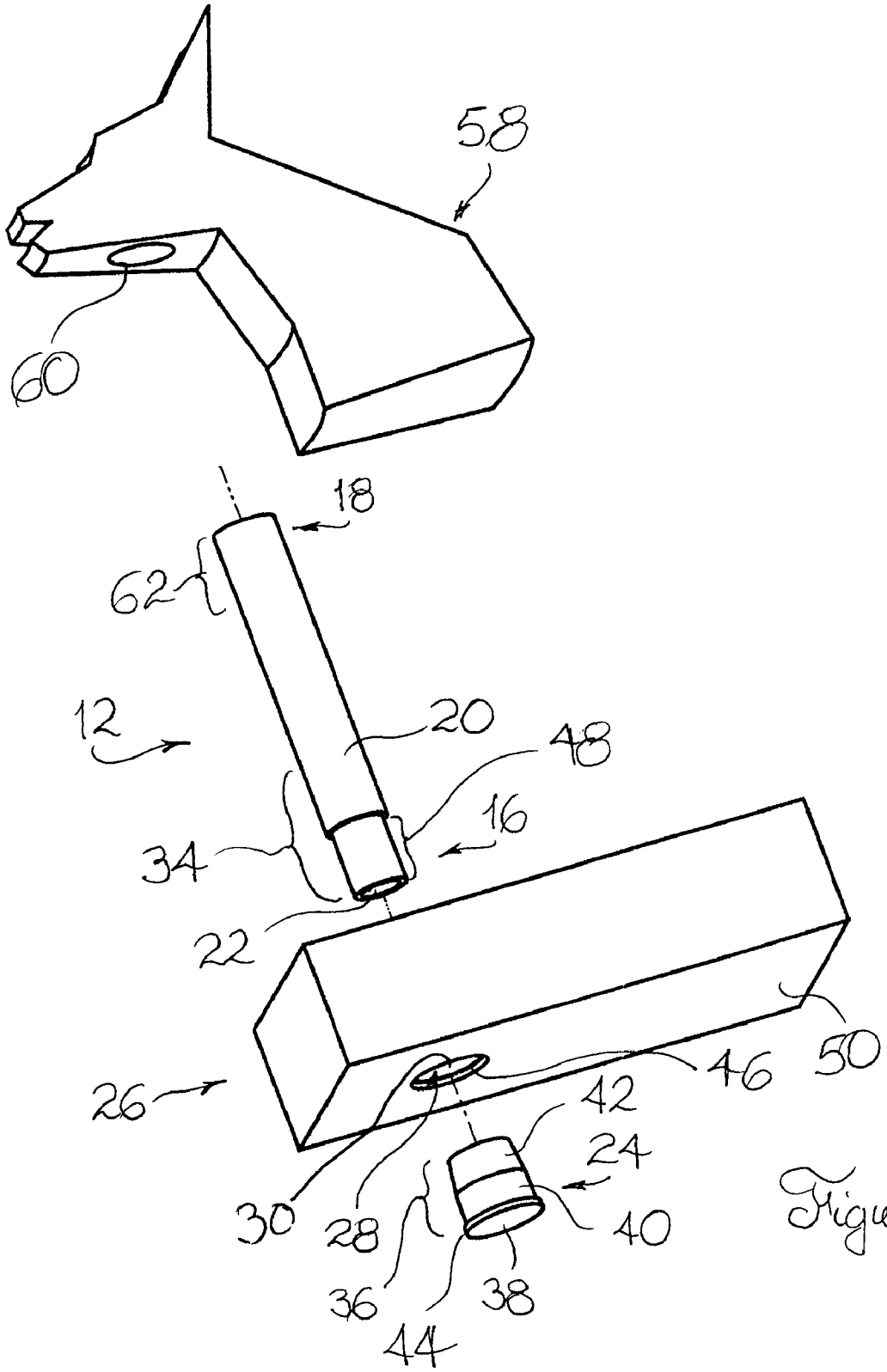
FIG. 3, in an exploded view, illustrates the display structure shown in FIGS. 1 and 2.
Figure 4:
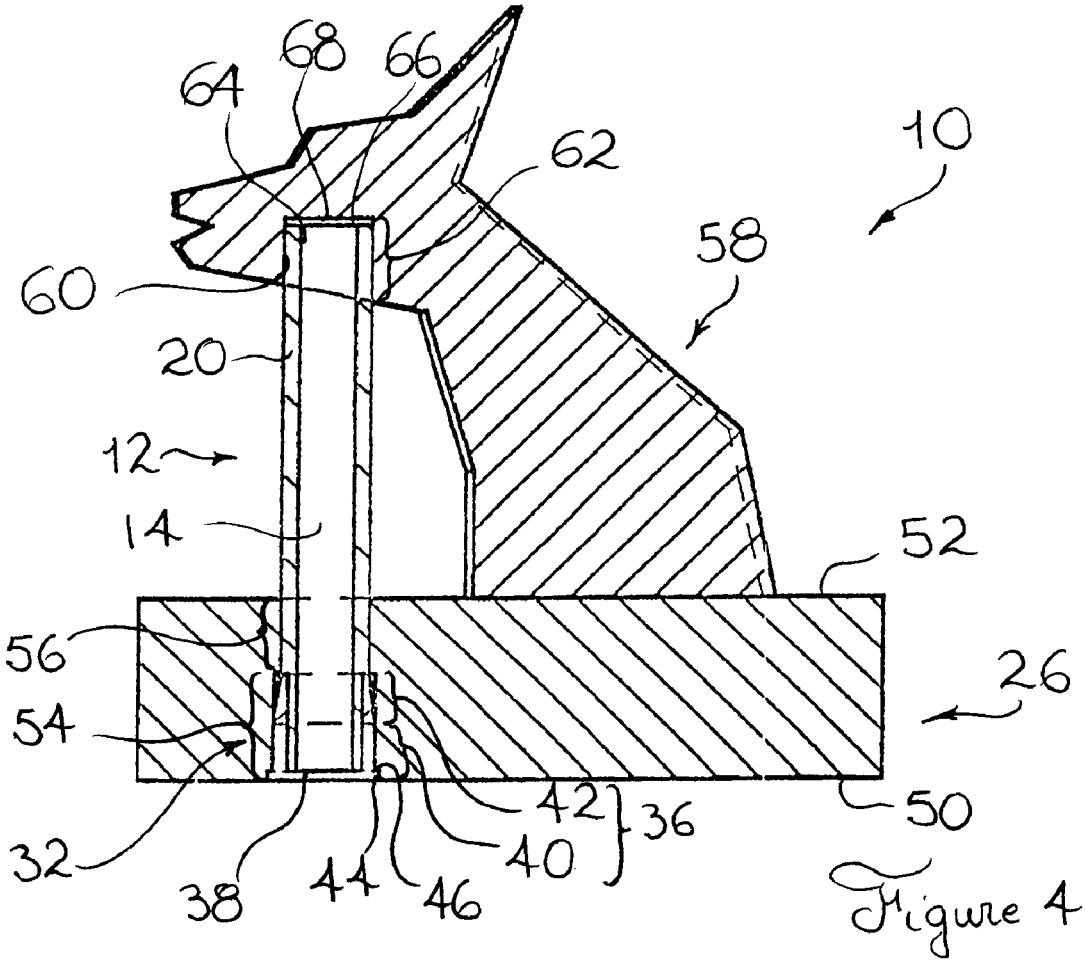
FIG. 4, in a cross-sectional view, illustrates the display structure shown in FIGS. 1 through 3.

As illustrated more specifically in FIG. 4, the display structure 10 includes a display container 12 defining a container inner volume 14 for containing the object. As illustrated more specifically in FIG. 3, the display container 12 typically has a substantially elongated configuration defining a container first end 16 and a substantially longitudinally opposed container second end 18.

Although the display container 12 is shown throughout the drawings as having a substantially cylindrical tubular configuration with a substantially disc-shaped cross-sectional configuration, it should be understood that the display container 12 could have other configurations without departing from the scope of the present invention. For example, the cross-sectional configuration of the display container 12 could be square, rectangular, triangular, polyhedral or have any other suitable configuration without departing from the scope of the present invention.

Also, although the display container 12 is shown as being substantially rectilinear, the display container 12 could have a substantially curved, zig zagged or otherwise shaped longitudinal configuration without departing from the scope of the present invention.

Still, furthermore, although the display container is shown as having a substantially constant longitudinal cross-sectional configuration, it should be understood that the display container 12 could have a cross-sectional configuration that varies along the length thereof without departing from the scope of the present invention. For example, the display container 12 could have a substantially spherical intermediate section leading to substantially cylindrical end sections without departing from the scope of the present invention.

The display container 12 is designed so as to allow at least partial visual access from the exterior thereof into at least a portion of the container inner volume 14. The display container 12 has a container peripheral wall 20. At least a portion of the container peripheral wall 20 is typically made out of substantially transparent or translucent material. Typically, although by no means exclusively, the container peripheral wall 20 may be manufactured out of glass or out of a suitable polymeric resin.

Optionally, the container peripheral wall 20 may be tinted, frosted, engraved or otherwise modified over its entirety or selected portions thereof without departing from the scope of the present invention.

As illustrated more specifically in FIG. 3, the display container 12 defines a container mouth or aperture 22 leading thereinto. The container aperture 22 is located substantially adjacent the container first end 16. In the embodiment shown throughout the drawings, the container aperture 22 is a channel extending longitudinally across the display container 12. It should, however, be understood that the container aperture 22 could extend only partially across the display container 12 or be otherwise located or oriented without departing from the scope of the present invention.

The display structure 10 also includes a container plug or cap 24. The container cap 24 is mountable to the display container 12 in a closing configuration for substantially closing the container aperture 22. In situations wherein the display container 12 is intended to be used for containing a fluid such as a liquid or a gas, the container cap 24 is mountable to the display container 12 so as to seal the container aperture 22.

The display structure 10 further includes a base member 26 for at least partially supporting the display container 12. The base member 26 has a container receiving aperture 28 extending at least partially therethrough. As illustrated more specifically in FIG. 4, the container receiving aperture 28 defines a receiving aperture peripheral surface 30.

The container receiving aperture 28 is configured and sized for receiving a receivable portion 34 of the display container 12 so as to at least partially support the display container 12 in a supported configuration shown in FIGS. 1 through 4.

The container cap 24 is provided with a contacting portion generally indicated by the reference numeral 32. The contacting portion 32 is configured, sized and positioned such that with the container cap 24 in the closing configuration shown in FIGS. 1 through 4 and the display container in the supported configuration, also shown in FIGS. 1 through 4, the contacting portion 32 contacts at least a portion of the container aperture peripheral wall 30.

The contact between the contacting portion 32 and at least a portion of the receiving aperture peripheral surface 30 at least partially supports the display container 12 in the supported configuration. Hence, with the container cap 24 in the closing configuration and the display container 12 in the supported configuration, the container cap 24 is used both for closing the container aperture 22 and for participating in the supporting of the display container 12.

The contacting portion 32 is typically also configured, sized and positioned such that, with the container cap 24 in the closing configuration and the display container 12 in the supported configuration, the contacting portion 32 frictionally contacts the receiving aperture peripheral surface 30 so as to frictionally retain the receivable portion 34 of the display container 12 and the container receiving aperture 28. Hence, when with the container cap 24 in the closing configuration and display container 12 in the supported configuration, the container cap 24 is also used for frictionally retaining the receivable portion 34 of the display container 12 and the container receiving aperture 28.

The contacting portion 32 is typically made out of a resiliently deformable material for being resiliently deformed when the receivable portion 34 of the display container 12 is received in the container receiving aperture 28. In the embodiment shown throughout the drawings, the container cap 24 is entirely made out of a substantially resiliently deformable material such as an elastomeric resin. In another embodiment of the invention (not shown), at least a portion of the container cap 24 is coated with a substantially resiliently deformable material.

In an embodiment of the invention (not shown), the contacting portion 32 protrudes substantially radially outwardly from the remainder of the container cap 24 for frictionally contacting the receiving aperture peripheral surface 30 so as to frictionally retain the receivable portion 34 of the display container 12 in the container receiving aperture 28. For example, in one embodiment of the invention (not shown), the contacting portion 32 is a peripheral contacting ring made out of an elastomeric material and protruding radially locally about the periphery of the container cap 24.

In the embodiment shown throughout the Figures, the display container 12 is a tube defining a tube wall outer surface.

As shown more specifically in FIG. 3, the container cap 24 includes a peripheral cap sleeve 36 mountable over the tube wall outer surface and a cap plate 38 extending from the cap sleeve 36 for extending across the container receiving aperture 22.

The cap sleeve 36 includes a sleeve first section 40 extending from the cap plate 38 and a sleeve second section 42 extending from the sleeve first section 40 away from the cap plate 38. The sleeve second section 42 tapers radially inwardly in a direction leading away from the sleeve first section 40.

The tapering configuration of the sleeve second section 42 is adapted to facilitate guidance and centering of the container cap 24 when the latter is pushed into the container receiving aperture 28. The tapering configuration of the sleeve second section 42 also facilitates gradual compression of the tubular sleeve first section 40 when the container cap 24 is introduced into the container receiving aperture 28.

In the embodiment shown throughout the drawings, the container cap 24 is further provided with a cap flange 44 extending substantially radially outwardly from the cap plate 38. The cap flange 44 is adapted to facilitate manipulation of the container cap 24 and also to act as a stopper for limiting the axial movement of the container cap 24 into the base member 26 by abuttingly contacting a corresponding flange abutment surface 46 provided in the base member 26.

In the embodiment shown throughout the drawings, the display container 12 is provided with a sleeve receiving section 48 for receiving at least a portion of the cap sleeve 36.

The sleeve receiving section 48 is located substantially adjacent the container first end 16. The sleeve receiving section 48 is recessed radially inwardly relative to the remainder of the tube wall outer surface. The depth of the sleeve receiving section 48 may be customized depending on the type of display container 12 being used. Hence, a standard container cap 24 may be used with tubular display containers 12 having various diameters by adjusting the depth of the sleeve receiving section 48.

Typically, the base member 26 defines a base first surface 50 and a substantially opposed base second surface 52. The container receiving aperture typically extends through the base member 26 from the base surface 50 to the base second surface 52. In other embodiments of the invention (not shown), the container receiving aperture 28 may extend only partially across the base member 26.

Typically, although by no means exclusively, the base first surface 50 has a substantially flat configuration. The base first surface 50, when flat, may hence be used for resting the display structure 10 on a supporting surface such as a table top or the like. In some embodiments of the invention (not shown), the base first surface 50 may be provided with legs extending therefrom or covered with a suitable material such as felt, a layer of polymeric material, a layer of anti-skid material or any other suitable material.

In the embodiment shown throughout the Figures, the display container 12 is shown extending in a substantially perpendicular relationship relative to the base first surface 50 when the display container 12 is in the supported configuration. It should, however, be understood that the display container 12 could be angled relative to the base first surface 50 without departing from the scope of the present invention.

Furthermore, in the embodiment shown throughout the Figures, the base member 26 is shown having a substantially parallelepiped-shaped configuration. It should, however, be understood that the base member 26 could have any other suitable configuration without departing from the scope of the present invention.

As shown more specifically in FIG. 4, in the embodiment shown throughout the Figures, the container receiving aperture 28 includes an aperture first section 54 extending from the base first surface 50 for receiving the cap sleeve 36 and an aperture second section 56 extending from the base second section 52 for receiving a portion of the display container 12. The cap sleeve 36 is configured, sized and positioned such that, with the container cap 24 in the closing configuration and the display container 12 in the supported configuration, the cap sleeve 24 frictionally contacts at least a portion of the receiving aperture peripheral surface 30 of the aperture first section 54 so as to frictionally retain the receivable portion 34 of the display container 12 in the container receiving aperture 28.

As shown in FIG. 4, the display container 12 and the aperture second section 56 are configured and sized such that when the display container 12 is in the supported configuration, the aperture second section 56 substantially fittingly receives the display container 12 so that the outer surface of the display container 12 contacts the receiving aperture peripheral surface 30 of the aperture second section 56. The contact between the outer surface of the display container 12 and the receiving aperture peripheral surface 30 of the aperture second section 56 at least partially supports the display container 12 in the supported configuration.

In fact, when using a container cap 24 having a resiliently deformable contacting portion, the tight fit of the display container 12 in the aperture second section 56 prevents lateral movement or tilting of the display container 12 that could result from the resilient deformation of the cap sleeve 36 within the aperture first section 54. Also, the tight fit of the display container 12 in the aperture second section 56 provides minimal spacing therebetween and, hence, prevents ingress of dust or other particles into the spacing between the display container 12 and the receiving aperture peripheral surface 30.

Typically, the display structure 10 further includes a stabilizing section 58 extending substantially outwardly from the base member 26. The stabilizing section 58 is configured, sized and positioned for contacting a portion of the display container 12 protruding from the base member 26 when the display container 12 is in the supported configuration. Typically, the stabilizing section 58 is configured, sized and positioned for contacting a portion of the display container 12 located substantially adjacent the container second end 18.

In the embodiment shown throughout the Figures, the stabilizing section 58 has the general configuration of the neck and head of a dog-type animal. It should, however, be understood that the stabilizing section 58 could have any other suitable configuration without departing from the scope of the present invention. Typically, the stabilizing section 58 has, in itself, an aesthetic or ornamental configuration. The stabilizing section 58, may, for example, have a visual appearance congruent with that of the object being displayed.

In at least one embodiment of the invention, the stabilizing section 58 is releasably attached to the base member 26 by a suitable releasable attachment for allowing various stabilizing sections 58 having various aesthetical features to be interchangeably attached to the base 26. The releasable attachment between the stabilizing section 52 and the base member 26 may take any suitable form such as any mechanical, magnetic or other type of releasable attachment without departing from the scope of the present invention.

In the embodiment shown throughout the Figures, the stabilizing section 58 is provided with a stabilizing recess 60 formed therein. The stabilizing section 58 and the stabilizing recess 60 are configured, sized and positioned such that a distal portion 62 of the display container 12 located adjacent the container second end 18 is received within the stabilizing recess 60 when the display container 12 is in the supported configuration. When a stabilizing recess 60 is provided, the stabilizing recess 60 may be configured and sized so as to either provide or prevent contact between the display container 12 and the stabilizing structure 58.

In at least one embodiment of the invention, the display container 12 is further provided with a container auxiliary aperture 64 leading thereinto. The container auxiliary aperture 64 is located substantially adjacent the container second end 18. The stabilizing recess has a recess surface 66. The stabilizing recess 60 may be configured, sized and positioned such that the recess surface 66 closes the container auxiliary aperture 64 when the auxiliary portion 62 of the display container 12 located adjacent the container second end 18 is received within the stabilizing recess 60 and the display container 12 is in the supported configuration. Hence, the recess surface 66 may act as a plug for closing or sealing the container auxiliary aperture 64.

Alternatively, the display structure 12 may be further provided with an auxiliary cap 68 for closing the auxiliary aperture 64. In such instances, the stabilizing recess 60 may be configured, sized and positioned for receiving the auxiliary cap 68 when the display container 12 is in the supported configuration. The auxiliary cap 68 may be made out of resiliently deformable material for being resiliently deformed when the auxiliary cap 68 is received in the auxiliary aperture 60.

The embodiments of the invention in which an exclusive privilege or property is claimed are defined as follows:

1. A display structure for displaying an object, said display structure comprising:

a display container defining a container inner volume for containing said object, said display container having a substantially elongated configuration defining a container first end and a substantially longitudinally opposed container second end, at least a portion of said display container being made out of substantially transparent or translucent material for allowing at least partial visual access from the exterior of said display container into at least a portion of said container inner volume; said display container defining a container aperture leading thereinto, said container aperture being located substantially adjacent said container first end;

a container cap, said container cap being mountable to said display container in a closing configuration for substantially closing said container aperture;

a base member for at least partially supporting said display container, said base member having a container receiving aperture extending at least partially therethrough, said container receiving aperture defining a receiving aperture peripheral surface; said container receiving aperture being configured and sized for receiving a receivable portion of said display container so as to at least partially support said display container in a supported configuration;

said container cap being provided with a contacting portion, said contacting portion being configured, sized and positioned such that with said container cap in said closing configuration and said display container in said supported configuration said contacting portion frictionally contacts at least a portion of said receiving aperture peripheral surface so as to frictionally retain said receivable portion of said display container in said container receiving aperture;

wherein with said container cap in said closing configuration and said display container in said supported configuration, said container cap is used both for closing said container aperture and for participating in the supporting of said display container.

2. A display structure as recited in claim 1, wherein said display container is a tube defining a tube peripheral wall having a tube wall outer surface;

said container cap includes a peripheral cap sleeve mountable over said tube wall outer surface and a cap plate extending from said cap sleeve for extending across said container receiving aperture, said contacting portion being defined by said cap sleeve;

said cap sleeve includes a sleeve first section extending from said cap plate and a sleeve second section extending from said sleeve first section away from said cap plate; said sleeve second section tapering radially inwardly in a direction leading away from said sleeve first section.

3. A display structure as recited in claim 1, wherein said display container is a tube defining a tube peripheral wall having a tube wall outer surface;

said container cap includes a cap sleeve mountable over said tube wall outer surface and a cap plate for extending across said container receiving aperture, said contacting portion being defined by said cap sleeve;

said container being provided with a sleeve receiving section for receiving at least a portion of said cap sleeve, said sleeve receiving section being located substantially adjacent said container first end; said sleeve receiving section being recessed radially inwardly relative to the remainder of said tube wall outer surface.

4. A display structure for displaying an object, said display structure comprising:

a display container defining a container inner volume for containing said object, said display container having a substantially elongated configuration defining a container first end and a substantially longitudinally opposed container second end, at least a portion of said display container being made out of substantially transparent or translucent material for allowing at least partial visual access from the exterior of said display container into at least a portion of said container inner volume; said display container defining a container aperture leading thereinto, said container aperture being located substantially adjacent said container first end;

a container cap, said container cap being mountable to said display container in a closing configuration for substantially closing said container aperture;

a base member for at least partially supporting said display container, said base member having a container receiving aperture extending at least partially therethrough, said container receiving aperture defining a receiving aperture peripheral surface; said container receiving aperture being configured and sized for receiving a receivable portion of said display container so as to at least partially support said display container in a supported configuration;

said container cap being provided with a contacting portion, said contacting portion being configured, sized and positioned such that with said container cap in said closing configuration and said display container in said supported configuration said contacting portion frictionally contacts at least a portion of said receiving aperture peripheral surface so as to frictionally retain said receivable portion of said display container in said container receiving aperture;

wherein with said container cap in said closing configuration and said display container in said supported configuration, said container cap is used both for closing said container aperture and for participating in the supporting of said display container; wherein said base member defines a base first surface and a substantially opposed base second surface, said container receiving aperture extending through said base member from said base first surface to said base second surface;

said display container is a tube defining a tube peripheral wall having a tube wall outer surface;

said container cap including a cap sleeve mountable over said tube wall outer surface and a cap plate for extending across said container receiving aperture, said contacting portion being defined by said cap sleeve;

said container receiving aperture includes an aperture first section extending from said base first surface for receiving said cap sleeve and an aperture second section extending from said base second surface for receiving a portion of said display container.

5. A display structure as recited in claim 4, wherein said display container and said aperture second section are configured and sized such that when said display container is in said supported configuration said aperture second section substantially fittingly receives said display container so that the outer surface of said display container contacts said receiving aperture peripheral surface of said aperture second section; the contact between said display container and said receiving aperture peripheral surface of said aperture second section at least partially supporting said display container in said supported configuration.

6. A display structure as recited in claim 4, further comprising a stabilizing section extending substantially outwardly from said base member, said stabilizing section being configured, sized and positioned for contacting a portion of said display container protruding from said base member when said display container is in said supported configuration.

7. A display structure as recited in claim 6, wherein said stabilizing section is configured, sized and positioned for contacting a portion of said display container located substantially adjacent to said container second end.

8. A display structure as recited in claim 7, wherein said stabilizing section is releasably attached to said base member.

9. A display structure as recited in claim 4, further comprising a stabilizing section extending substantially outwardly from said base member, said stabilizing section being provided with a stabilizing recess formed therein, said stabilizing section and said stabilizing recess being configured, sized and positioned such that a portion of said display container located adjacent said container second end is received within said stabilizing recess when said display container is in said supported configuration.

10. A display structure as recited in claim 9, wherein said stabilizing section is releasably attached to said base member.

11. A display structure as recited in claim 9 wherein said display container has a container auxiliary aperture leading thereinto, said container auxiliary aperture being located substantially adjacent said container second end; said stabilizing recess having a recess surface, said stabilizing recess being configured, sized and positioned such that a said recess surface closes said container auxiliary aperture when said portion of said display container located adjacent said container second end is received within said stabilizing recess with said display container in said supported configuration.

12. A display structure as recited in claim 9 wherein said display container has a container auxiliary aperture leading thereinto, said container auxiliary aperture being located substantially adjacent said container second end; said display structure being further provided with an auxiliary cap for closing said auxiliary aperture; said stabilizing recess having a recess surface, said stabilizing recess being configured, sized and positioned for receiving said auxiliary cap when said display container is in said supported configuration.

13. A display structure as recited in claim 12 wherein at least an auxiliary portion of said auxiliary cap is made out of resiliently deformable material for being resiliently deformed when said auxiliary cap is received in said auxiliary aperture.

* * * * *